US005310286A

United States Patent [19]

Gilbert et al.

[11] Patent Number: 5,310,286

[45] Date of Patent: May 10, 1994

[54] CASED GLORY HOLE SYSTEM

[75] Inventors: Denis Gilbert, Airdrie; Ian MacGregor, Calgary, both of Canada

[73] Assignees: Tornado Drill Ltd., Alberta; Volker Stevin Offshore Canada Inc., Calgary, both of Canada

[21] Appl. No.: 871,455

[22] Filed: Apr. 21, 1992

[51] Int. Cl.[5] ..... F16L 1/16; E02B 17/02

[52] U.S. Cl. ..... 405/169; 166/356; 405/211

[58] Field of Search ..... 405/157, 169, 195.1, 405/211; 166/347, 356, 364

[56] References Cited

U.S. PATENT DOCUMENTS 3,866,676 2/1975 Burns ..... 166/364 X
4,171,174 10/1979 Larsen ..... 405/157 X
4,273,472 6/1981 Piazza et al. ..... 405/211
4,397,586 8/1983 Weiss ..... 405/211 X
4,919,210 4/1990 Schaefer ..... 166/356

*Primary Examiner*—David H. Corbin
*Attorney, Agent, or Firm*—Seed and Berry

[57] ABSTRACT

A glory hole silo comprising a cylindrical casing open at the upper end thereof; an upwardly open porch for supporting a flowline, said porch extending horizontally from and cantilevered with respect to said casing, the upper surface of said porch opening to the interior of said casing and provided with means communicating with the interior of said casing for attaching a flowline; and a removable roof extending over the open upper end of said casing and porch. The porch structure permits flowlines to be readily connected without the intervention of a diver.

6 Claims, 18 Drawing Sheets

CASED GLORY HOLE SYSTEM

FIELD OF THE INVENTION

The invention relates to offshore oil wells and more particularly to structures for the protection of sub-sea wellheads.

BACKGROUND OF THE INVENTION

In offshore oil exploration, it is often necessary to protect sub-sea equipment from damage from anchors, nets, icebergs and other marine hazards. Equipment protruding from the sea floor in high traffic areas such as shipping lanes is in danger of damaging or being damaged by passing vessels. Environmental damage can result from oil spills caused by damage to the wellhead equipment by such hazards. To date, sub-sea drilling equipment such as blowout preventers, and well completion equipment, such as "Christmas trees" have been located at the sea floor level, leaving them exposed to such damage. In some areas the subsea production equipment has been covered with a structure resembling a bee-hive, although drilling equipment has been unprotected.

The problem is particularly acute in Arctic waters where the ice pack and icebergs scour the ocean floor with great force. Consequently, excavations in the ocean floor, called glory holes, have been used to keep equipment below the ice keel interaction zone or to protect the wellhead from damage from anchors, fishing equipment, or shipping. The glory holes are excavated by dredging a depression of sufficient size so that the slopes are stable. These holes can be expensive to dredge where difficult soil conditions are encountered or the water is deep. Also the protection provided against scouring by ice is imperfect, as the ice pushes a pile of rubble ahead of it as it scours the ocean floor, and little protection from anchors, fishing nets and the like is provided.

Improvements to the conventional uncased glory hole have been proposed in a paper entitled "Gloryhole Tool: Design, Fabrication and Operation" by H. R. Stewart, I. MacGregor, T. V. Goudoever and R. E. Isted presented at the 1986 Arctic Offshore Technology Conference, Calgary, Alberta, a paper entitled "Beaufort Sea Cased Gloryhole Drilling" by D. Gilbert, I. MacGregor, and K. J. Vargas presented at the Eighth International Conference on Offshore Mechanics and Arctic Engineering Mar. 19-23, 1989 and in a paper presented at the 21st Annual Offshore Technology Conference in Houston, Texas, May 1-4, 1989, entitled "Drilling and Installing Large-Diameter Caissons for Wellhead Protection" by B. W. Meadows and D. C. Gilbert. According to this method, a glory hole tool is used to drill a cylindrical glory hole 7 to 14 meters in diameter. The glory holes are typically 8 meters in diameter for exploration wells and 13 meters in diameter for production wells. Such holes will be 10 to 20 meters deep. A cylindrical metal casing is left in the glory hole when the tool is retracted. The glory hole can be drilled from a drilling rig or a support vessel or barge.

As described in the papers noted above, the glory hole excavation system uses a bit consisting of a rigid and a rotating section. The rigid section includes the main ratchet drive assembly, a structural roof section which incorporates retractable pins for disengaging from the casing, and a peripheral skirt which acts as a foundation for the casing. The rotating component has three unequal length cutter arms with separately rotating cutting discs and a central penetration spear. Retractable spades extend horizontally from the drilling end to prevent rotation. The cylindrical casing system consists of a leading skirt followed by a corrugated metal pipe which is supplied in sections bolted to the skirt and each other. The top section is sacrificial so that the upper cylindrical section of the casing can shear off if scoured by ice without dislodging the rest of the casing. The casing is carried with the bit and after completion of the glory hole excavation it is released from the bit to remain in the glory hole.

Various patents are of interest in the area of cased sub-sea wells or glory holes. Canadian Patent no. 995,583 issued Aug. 24, 1976 discloses a sub-sea well structure in which the production equipment is protected by a cased cavity below the ocean floor. U.S. Pat. No. 4,744,698 issued May 17, 1988 discloses a method of installing marine silos or caissons for forming a protective chamber for sub-sea wells.

Cased glory holes provide a number of advantages. They are faster and less expensive to make, as less material is moved. Better protection against ice scouring, anchors, fishing nets and trawling boards is provided. However certain problems remain. The cased glory holes may fill with silt, particularly where adjacent drilling operations are disturbing the sea bed. Over time the accumulation of silt can interfere with the operation and maintenance of equipment in the glory hole. Also very large diameter glory holes provide less protection against anchors, nets and the like. Currently, human divers are used to make necessary connections and carry out operations in the glory hole, which is risky and expensive, particularly in deep water.

SUMMARY OF THE INVENTION

The present invention is an improved cased glory hole which has a roof to prevent accumulation of silt in the glory hole and to provide additional protection against boat anchors and fishing nets, a guide base which locks into place in the bottom of the glory hole casing, and a flowline connection system which facilitates connecting flowlines from the wellhead to an external pipeline without the intervention of a human diver.

BRIEF DESCRIPTION OF THE DRAWINGS

In drawings which illustrate a preferred embodiment of the invention.

Figure 9:
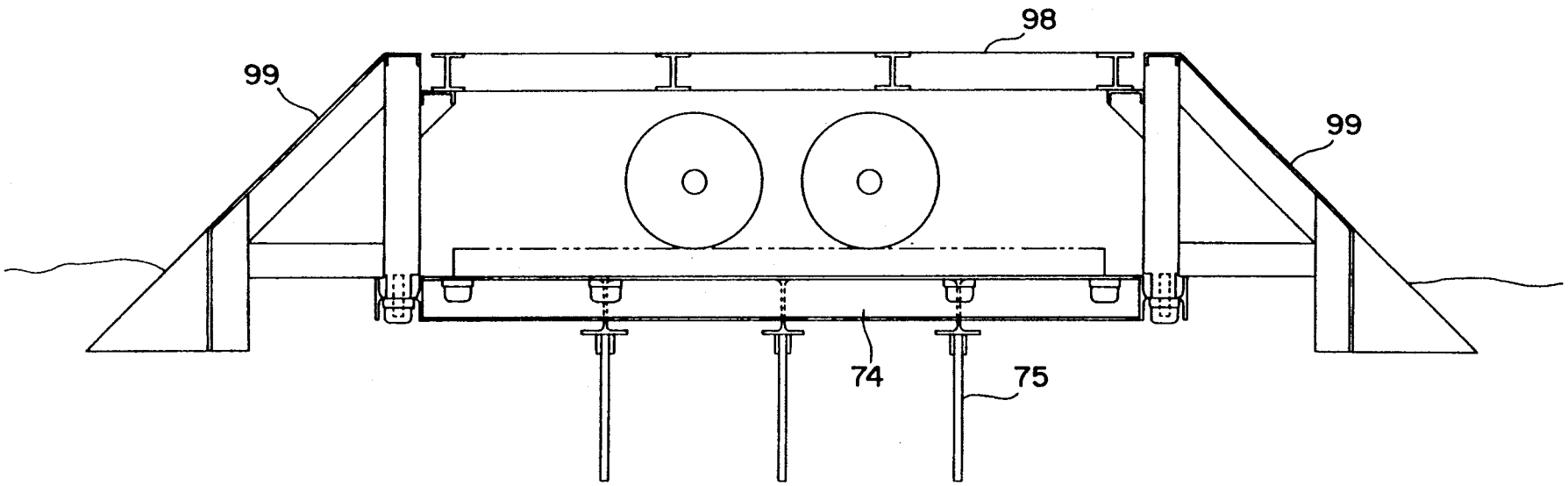
Figure 10:
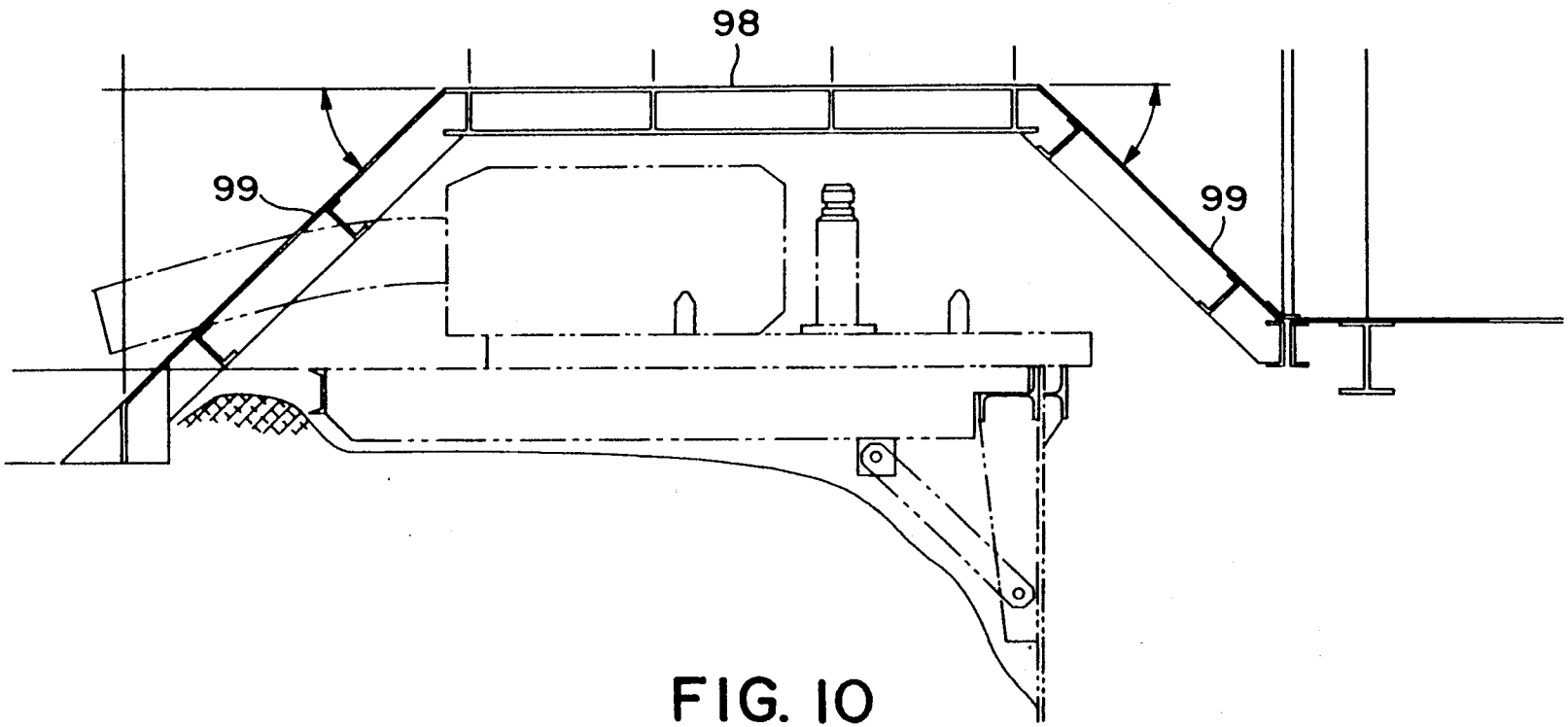
Figure 11:
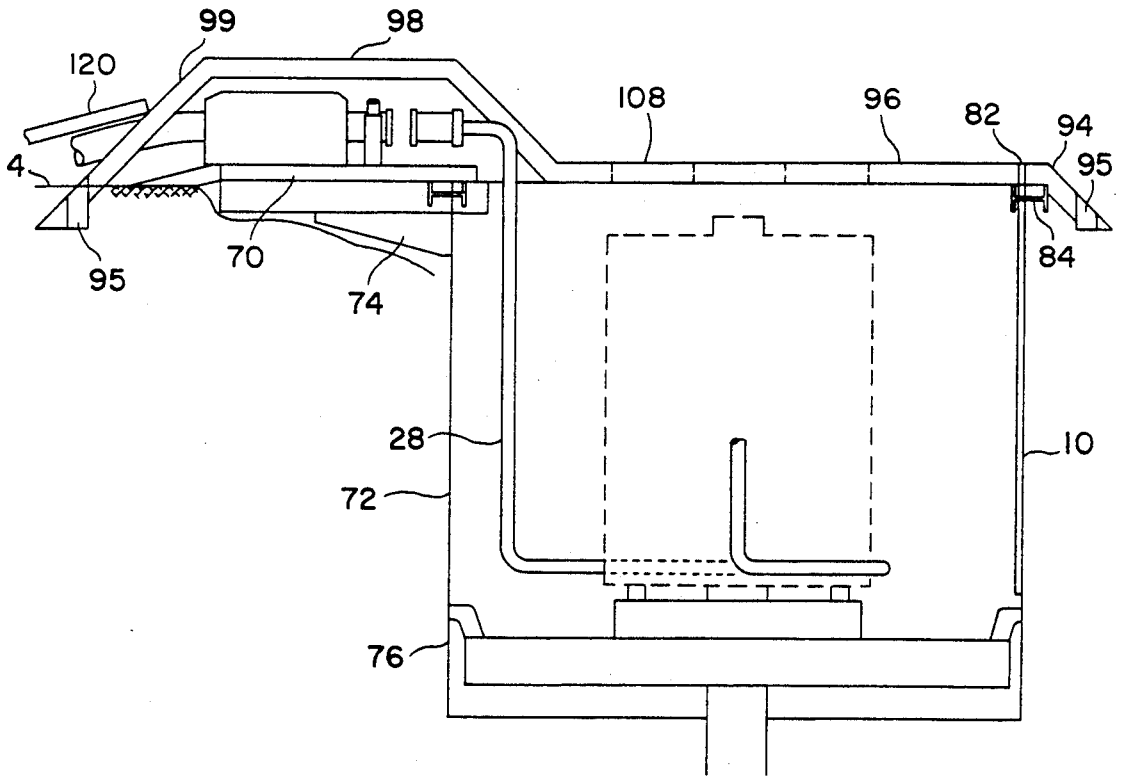

FIGS. **8*a*-8*c*** illustrate the method of installation of the guidebase of the invention;

FIG. 9 is a sectional view of a second embodiment of the porch section of the invention as shown in FIG. 11;

FIG. 10 is an end view of the porch section shown in FIG. 9.

Figure 12:
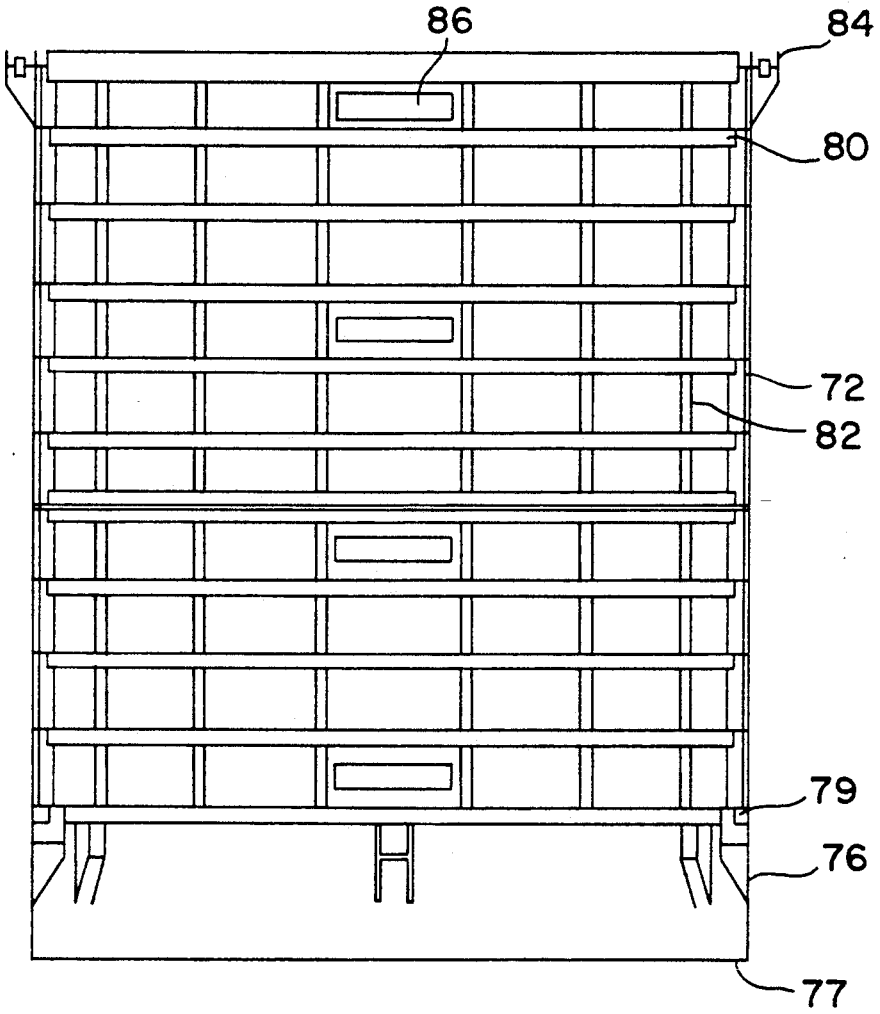
Figure 13:
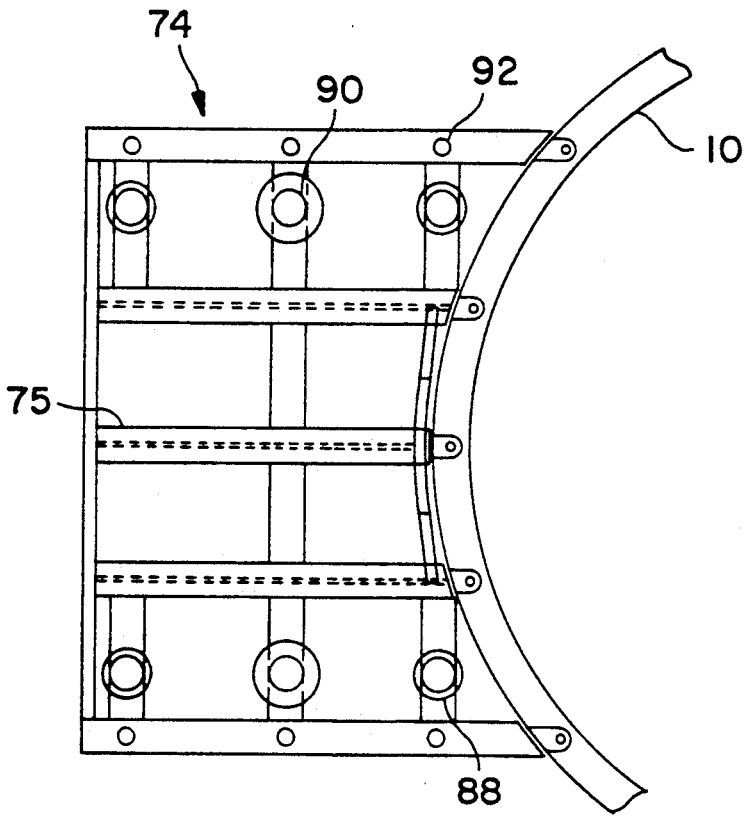
Figure 14:
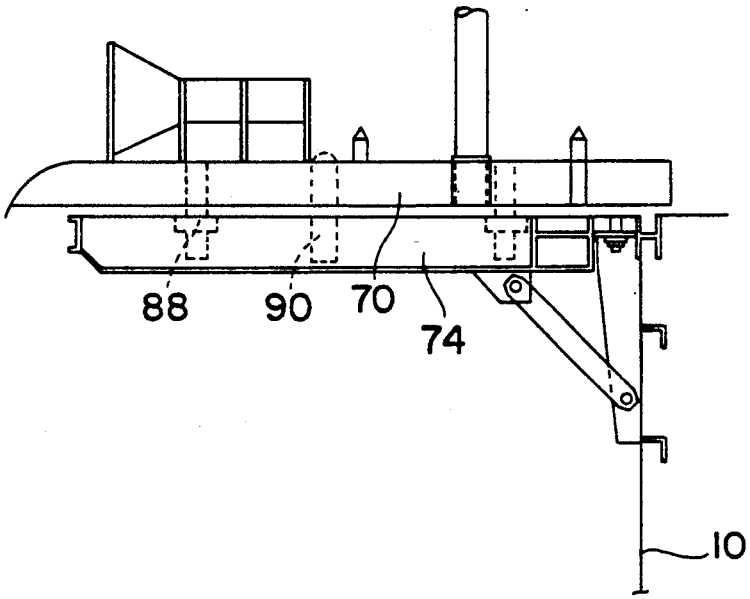
Figure 15:
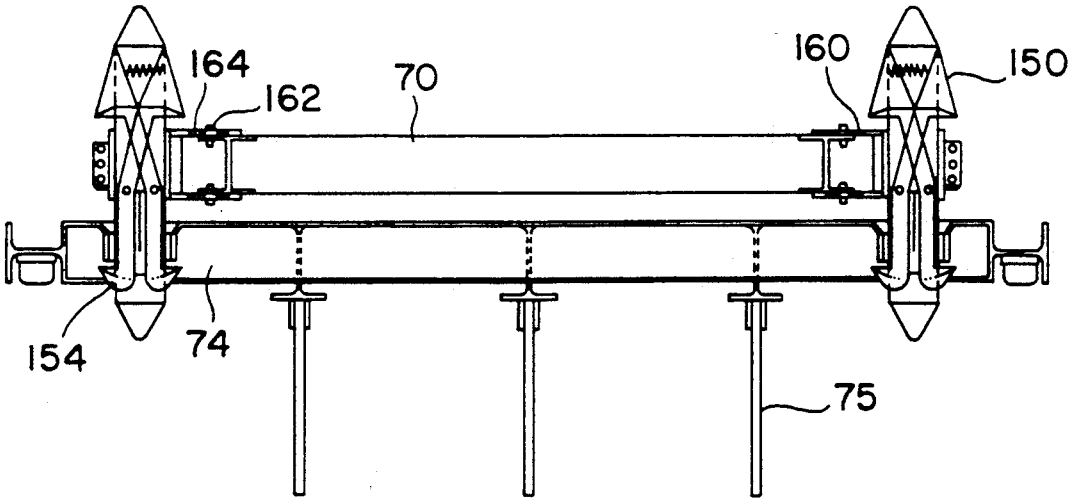
Figure 16:
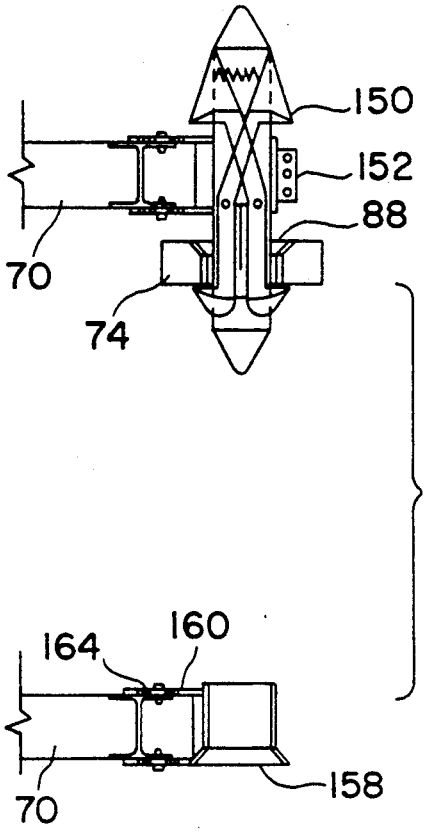
Figure 17:
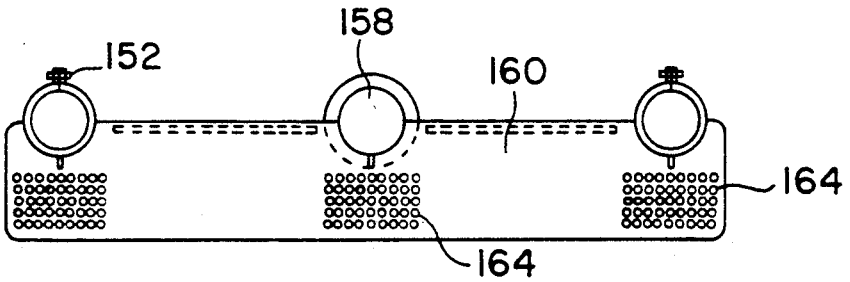
Figure 18:
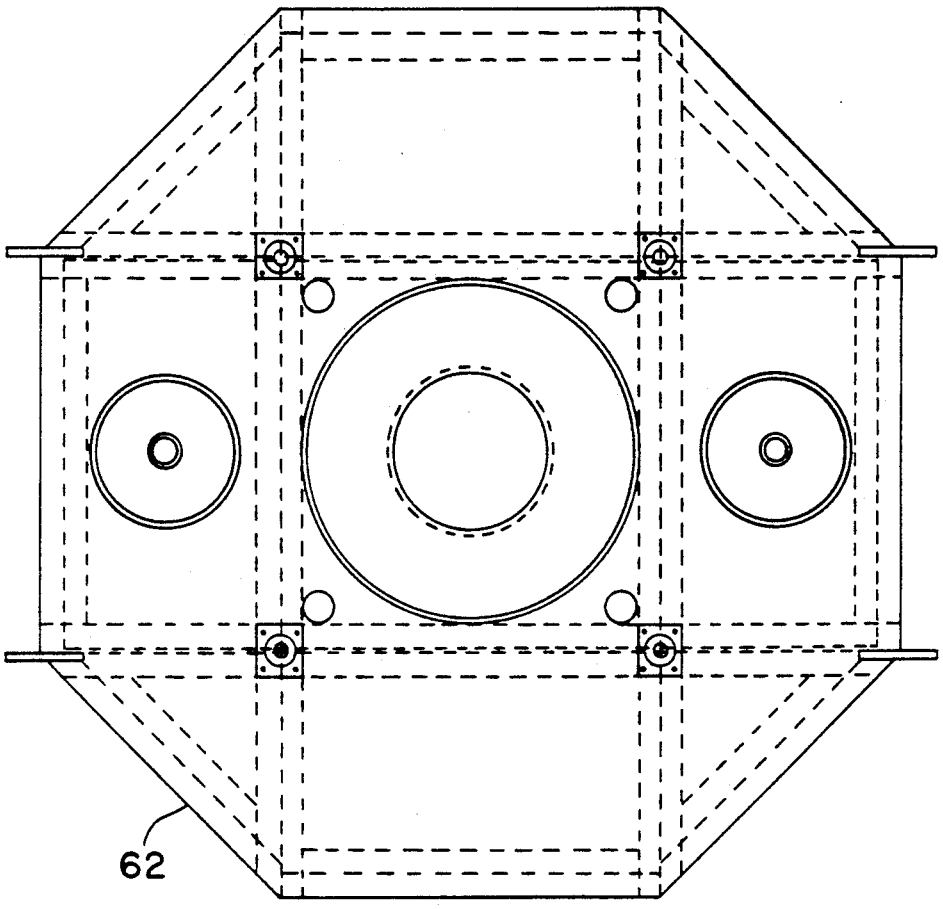
Figure 19:
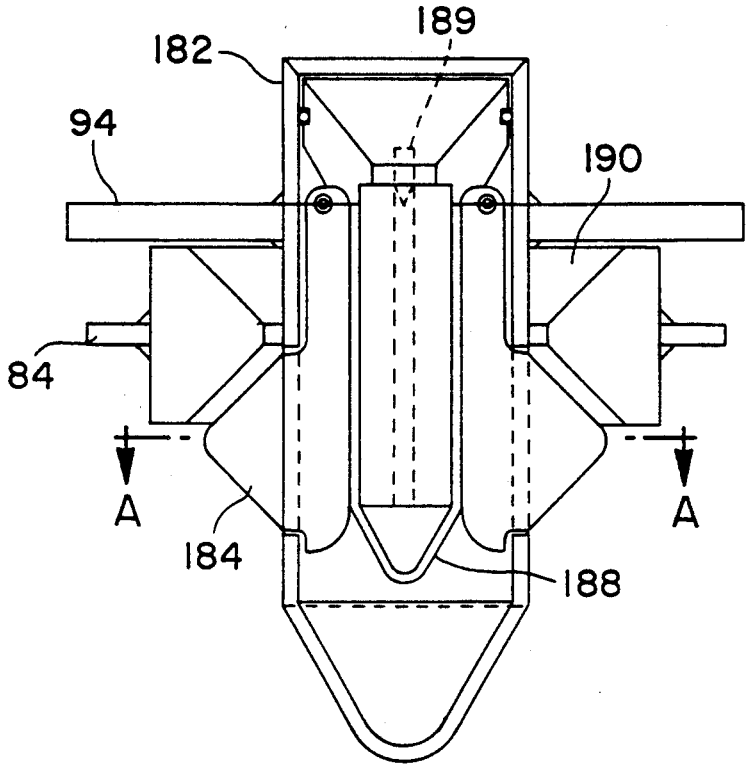
Figure 20:
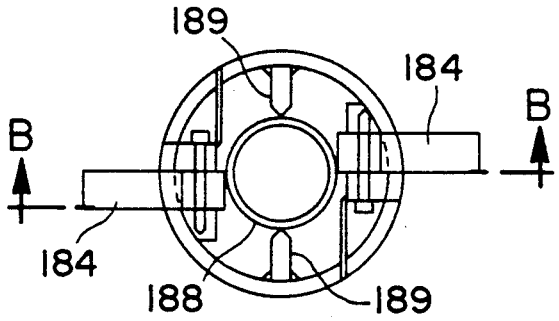
Figure 21:
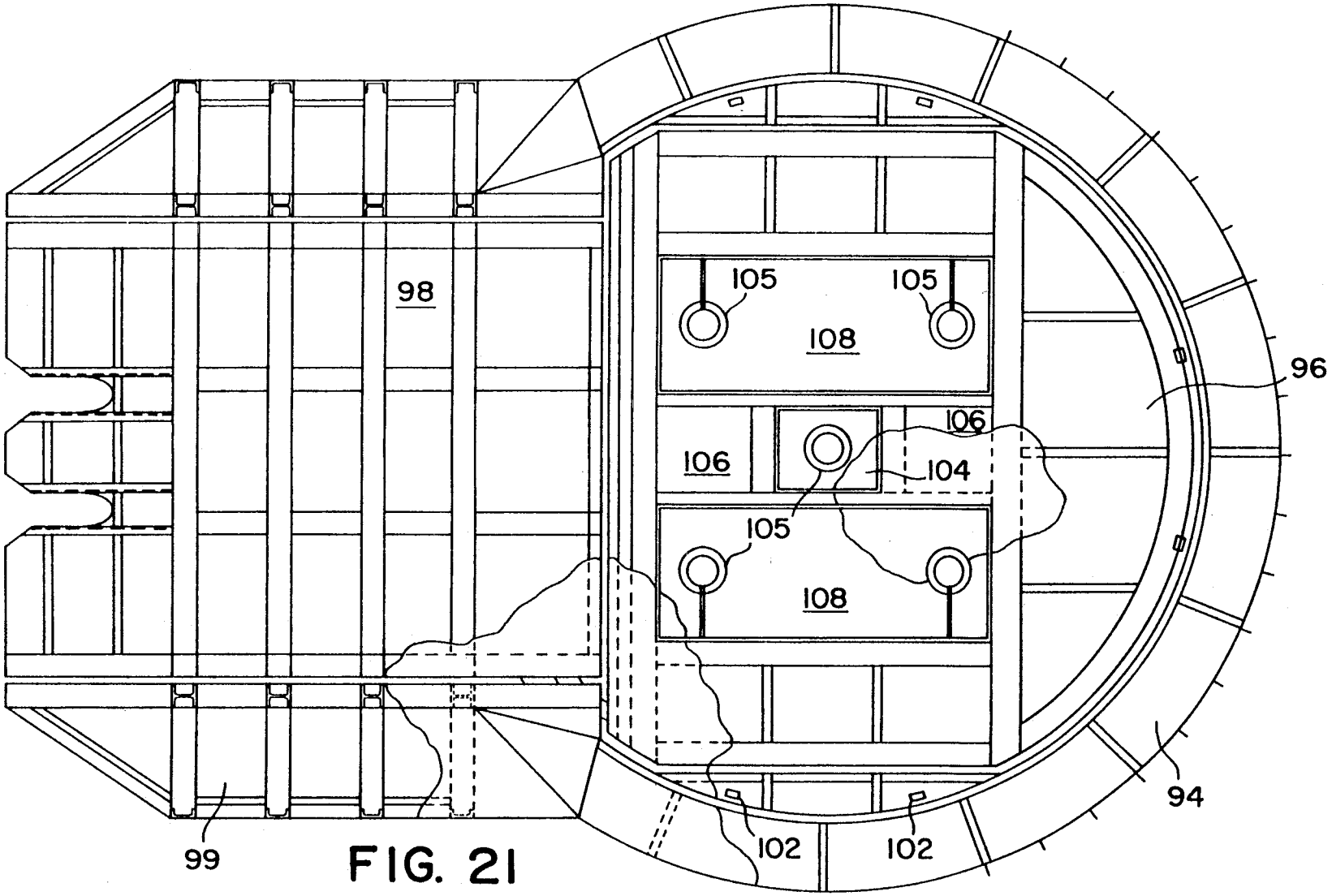

FIG. 11 is a vertical cross-section of a second embodiment of the silo and porch construction of the invention;

FIG. 12 is a cross-sectional view of the silo of the invention with the porch and roofs removed;

FIG. 13 is a plan view of the porch support of the invention;

FIG. 14 is an elevation of the porch support shown in FIG. 13;

FIG. 15 is an end view of the porch support shown in FIG. 13;

FIG. 16 is a detail view showing operation of the stab lock location on the porch support;

FIG. 17 is a plan view of the porch adjustment wings;

FIG. 18 is a plan view of the guide base;

FIG. 19 is a vertical sectional view of the side wall stab-in connection;

FIG. 20 is a sectional view of the stab-in connection taken along lines XX—XX of FIG. 19; and FIG. 21 is a plan view of the roof of the invention.

DETAILED DESCRIPTION OF THE PREFERRED EMBODIMENT

Figure 1:
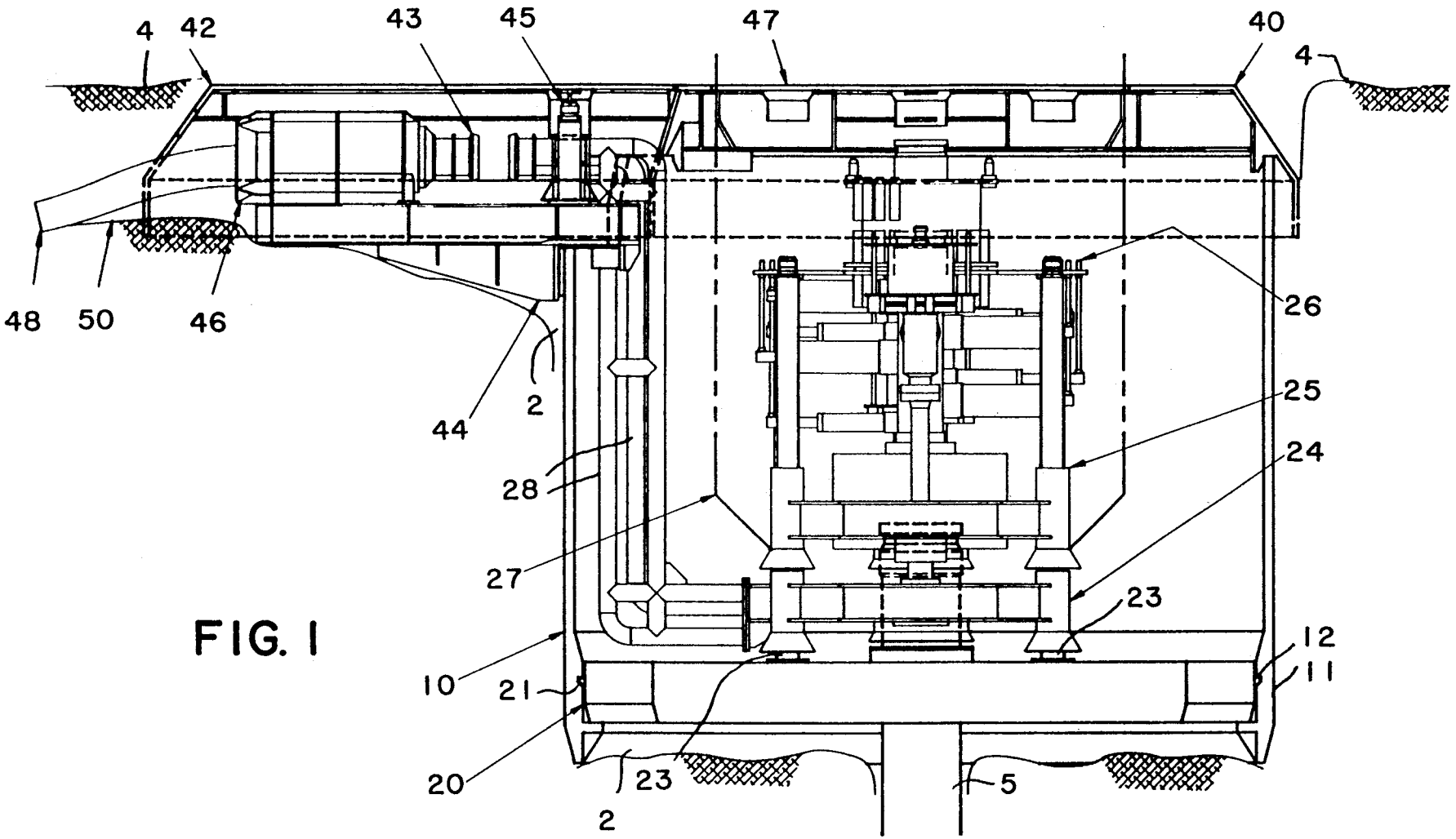
FIG. 1 is a vertical cross-section of the invention taken along lines 1—1 of FIG. 2.
Figure 2:
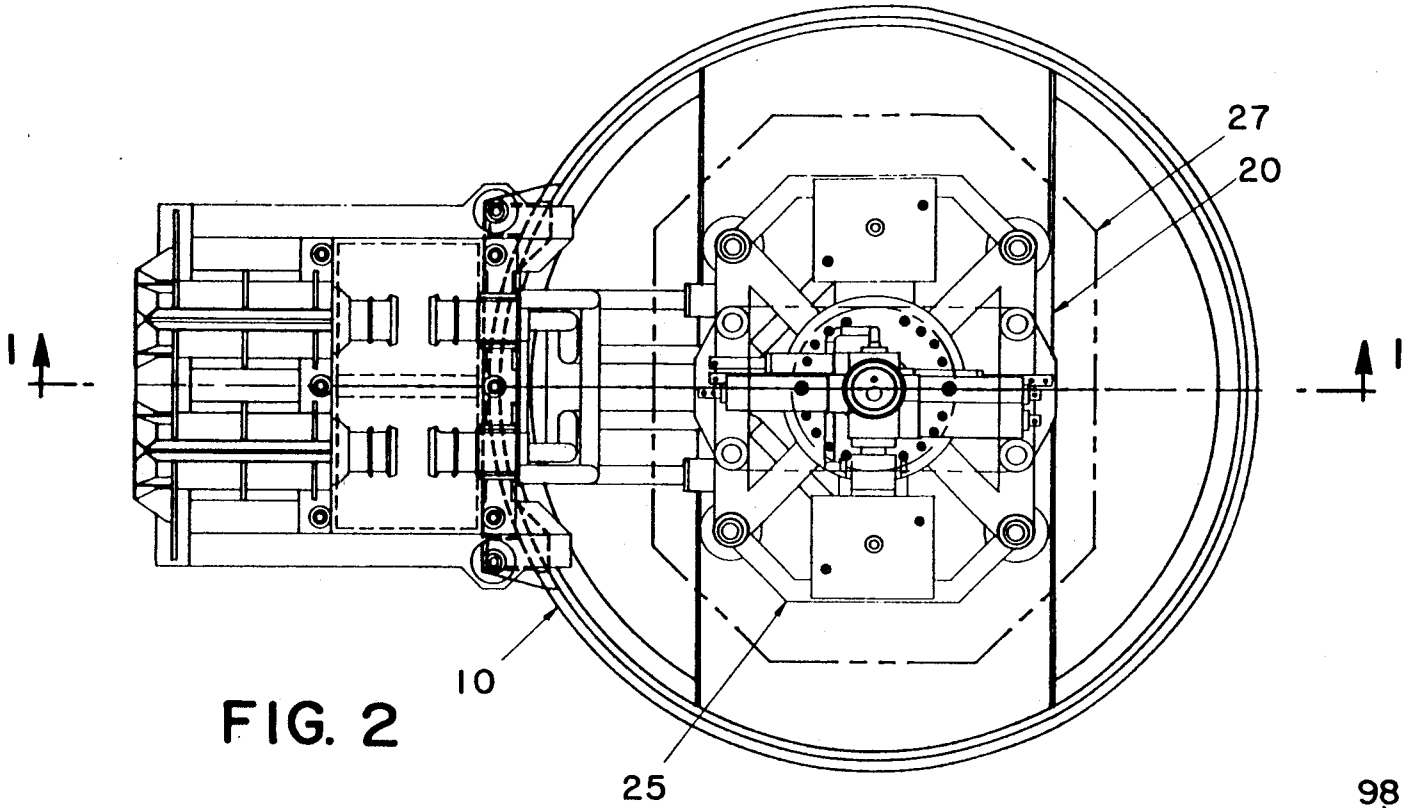
FIGS. 2 and 2A are top views of the invention with the roofs removed.
Figure 2A:
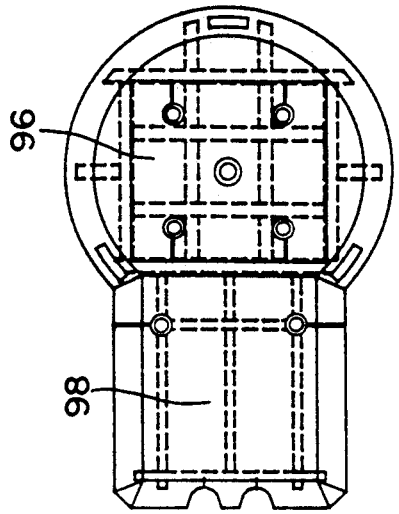
Figure 3:
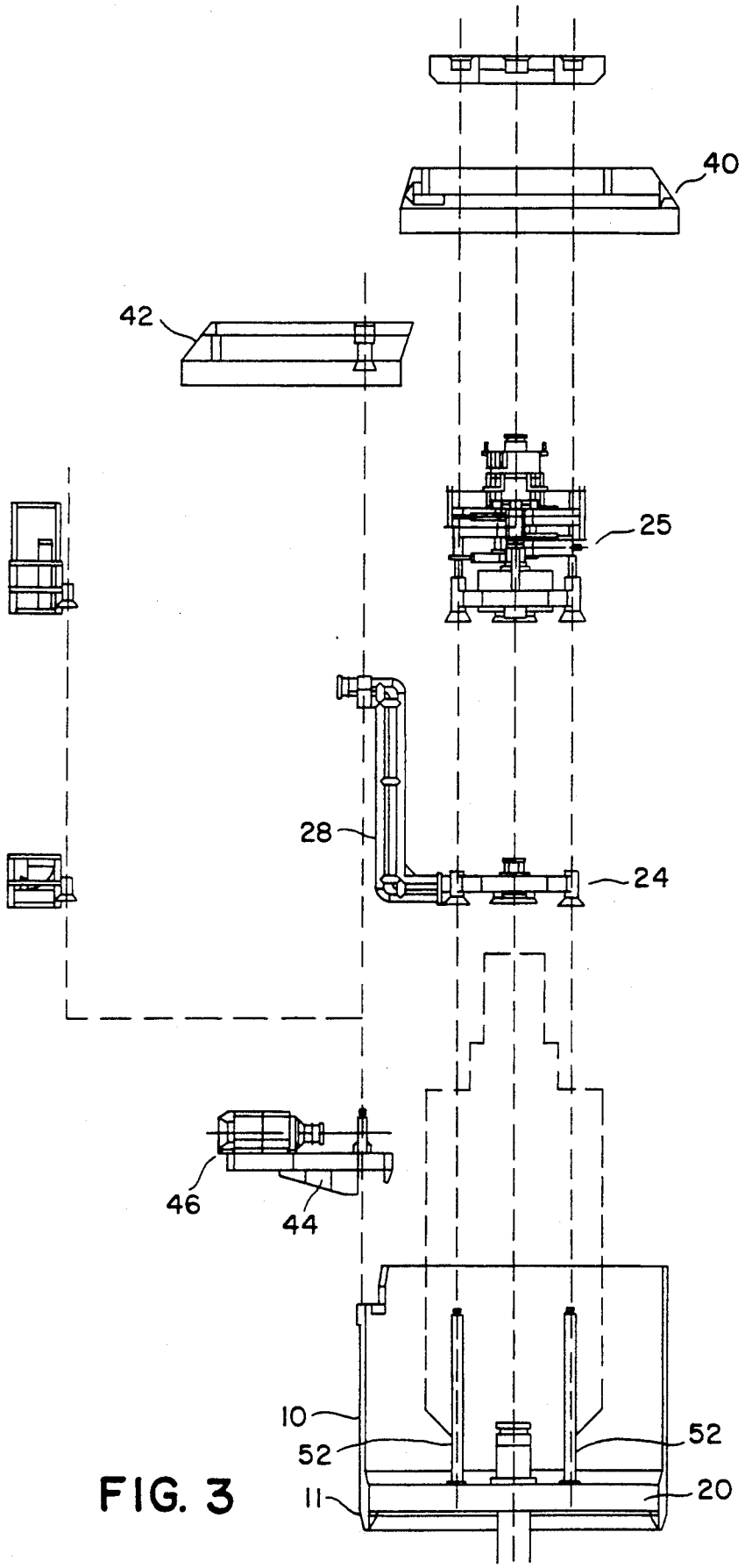
FIG. 3 is an exploded view showing construction of the glory hole of the invention.
Figure 4:
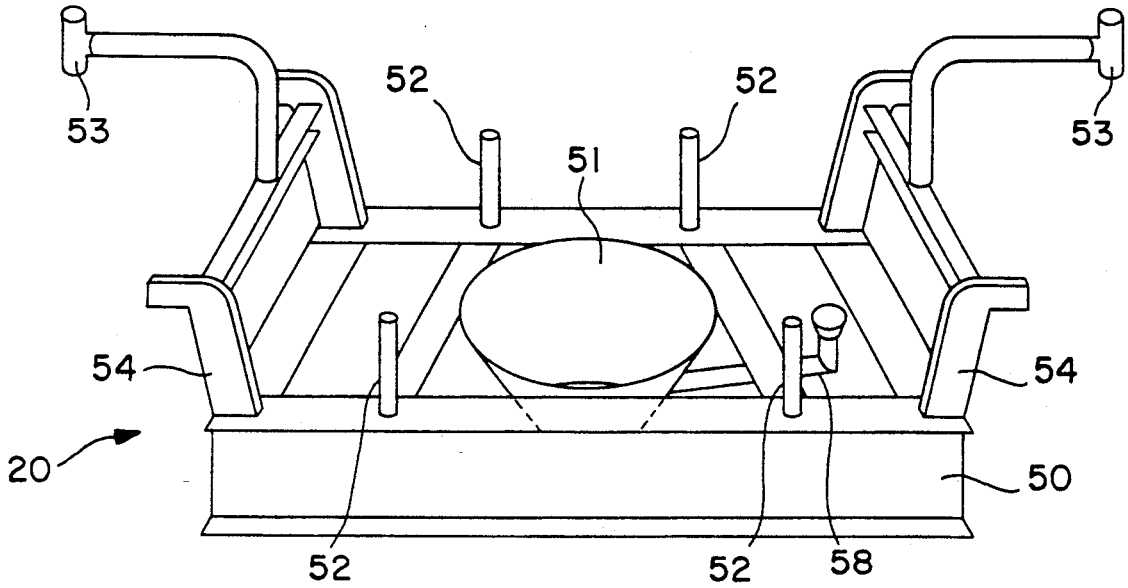
FIG. 4 is a perspective view of the guide base of the invention.
Figure 5:
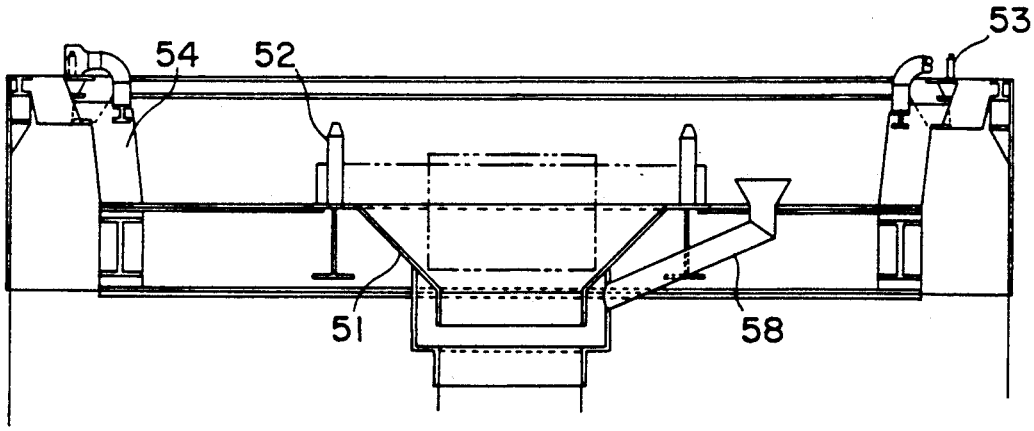
FIG. 5 is a sectional view of the guide base invention taken along line A of FIG. 7.
Figure 6:
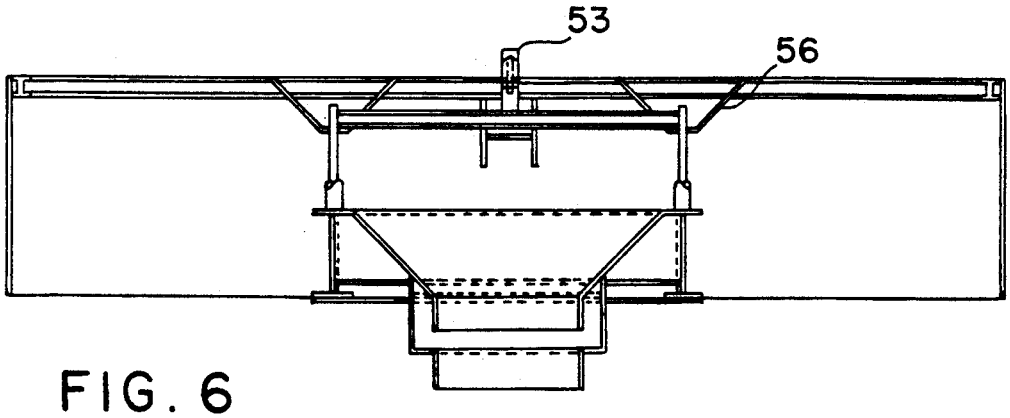
FIG. 6 is a sectional view of the guide base of the invention taken along line B of FIG. 7.
Figure 7:
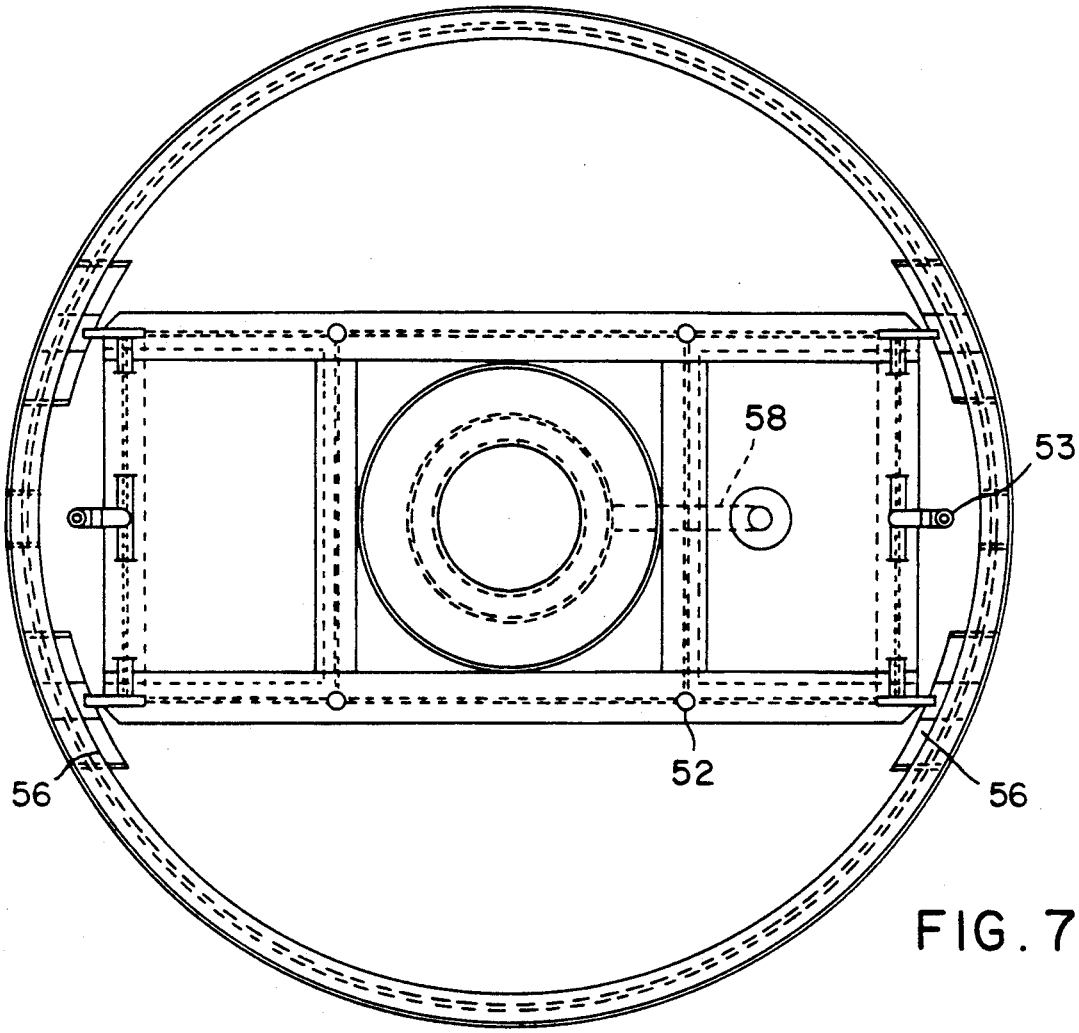
FIG. 7 is a top view of the guide base of the invention.
Figure 8A:
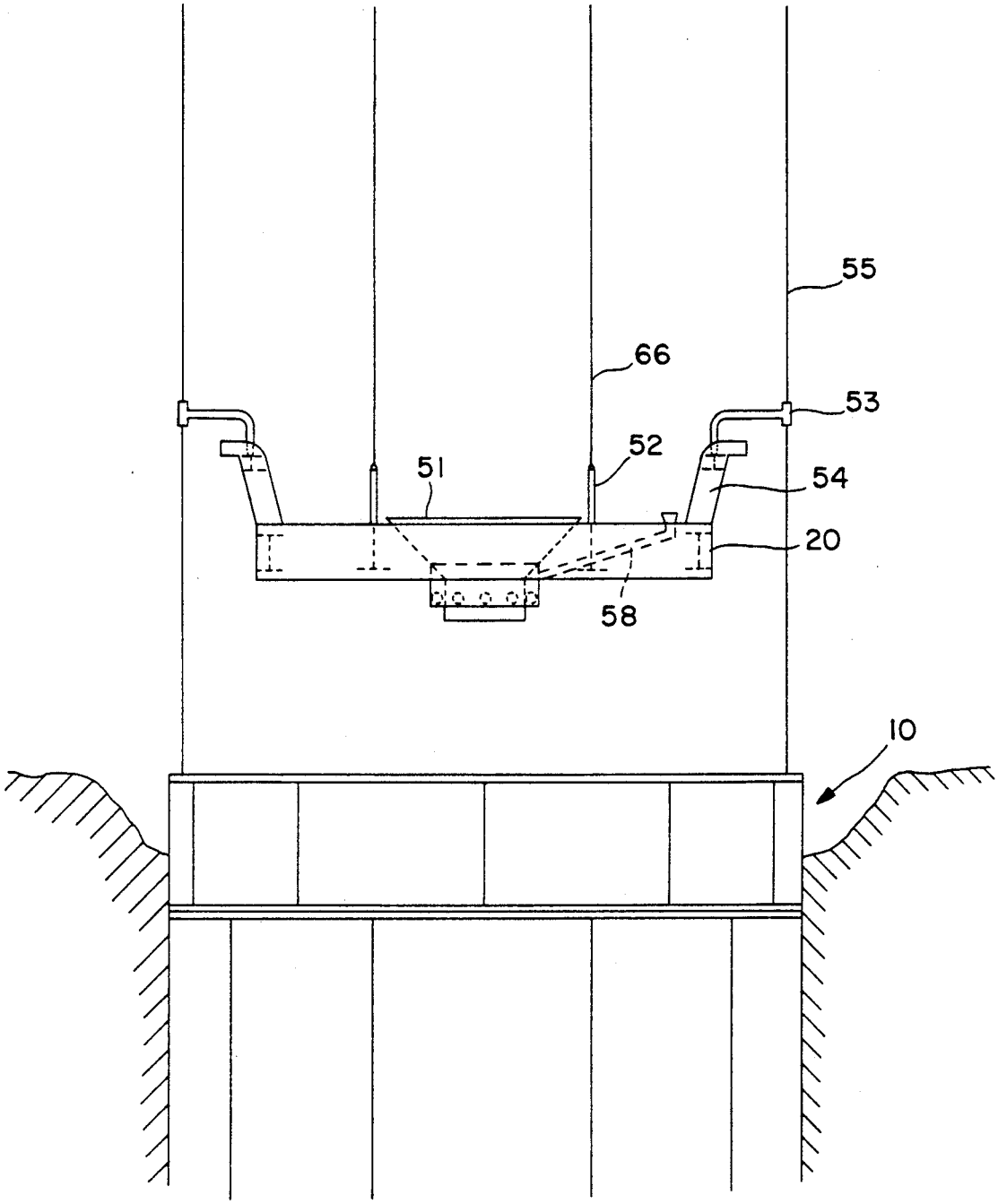
Figure 8B:
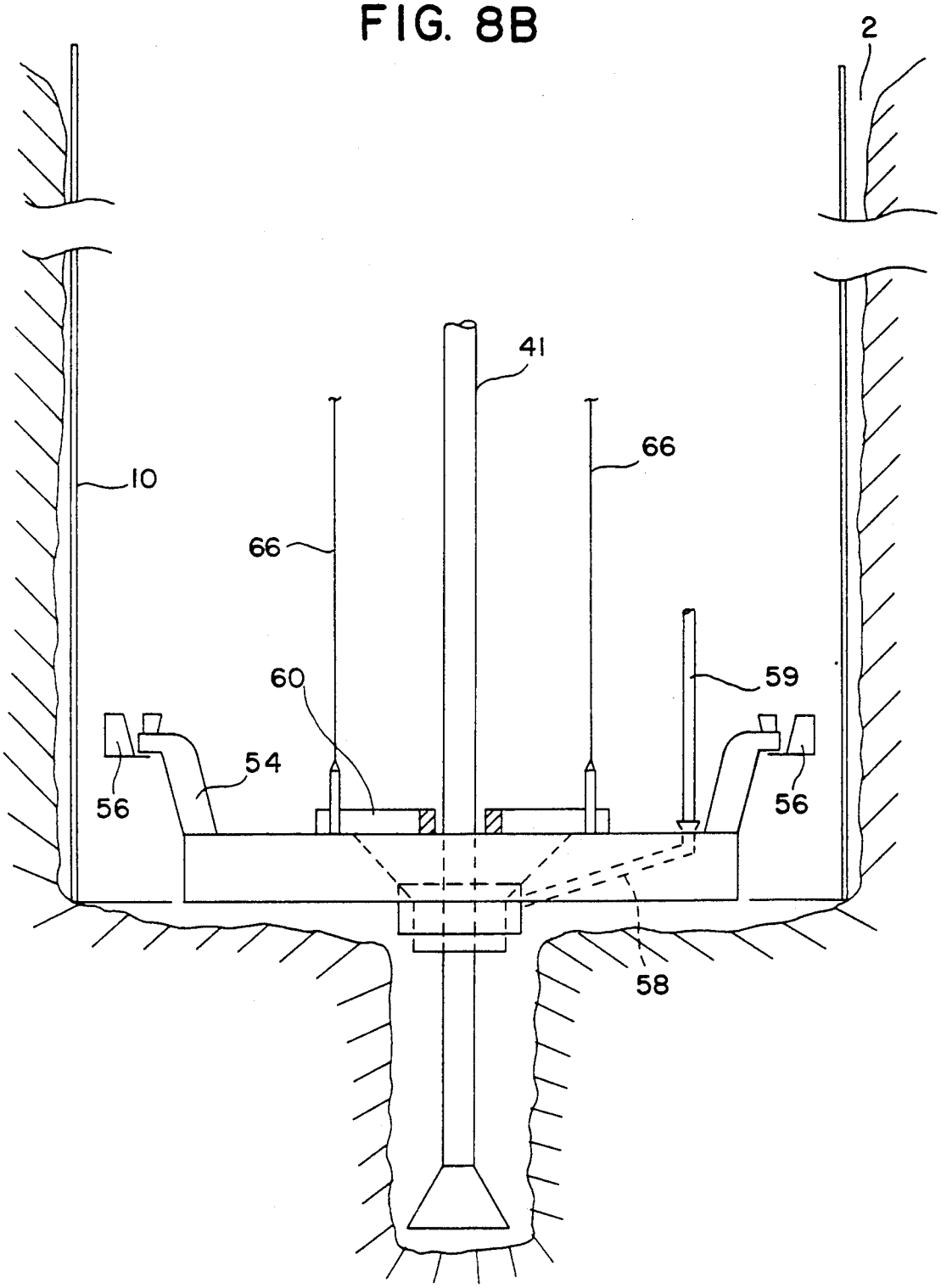
Figure 8C:
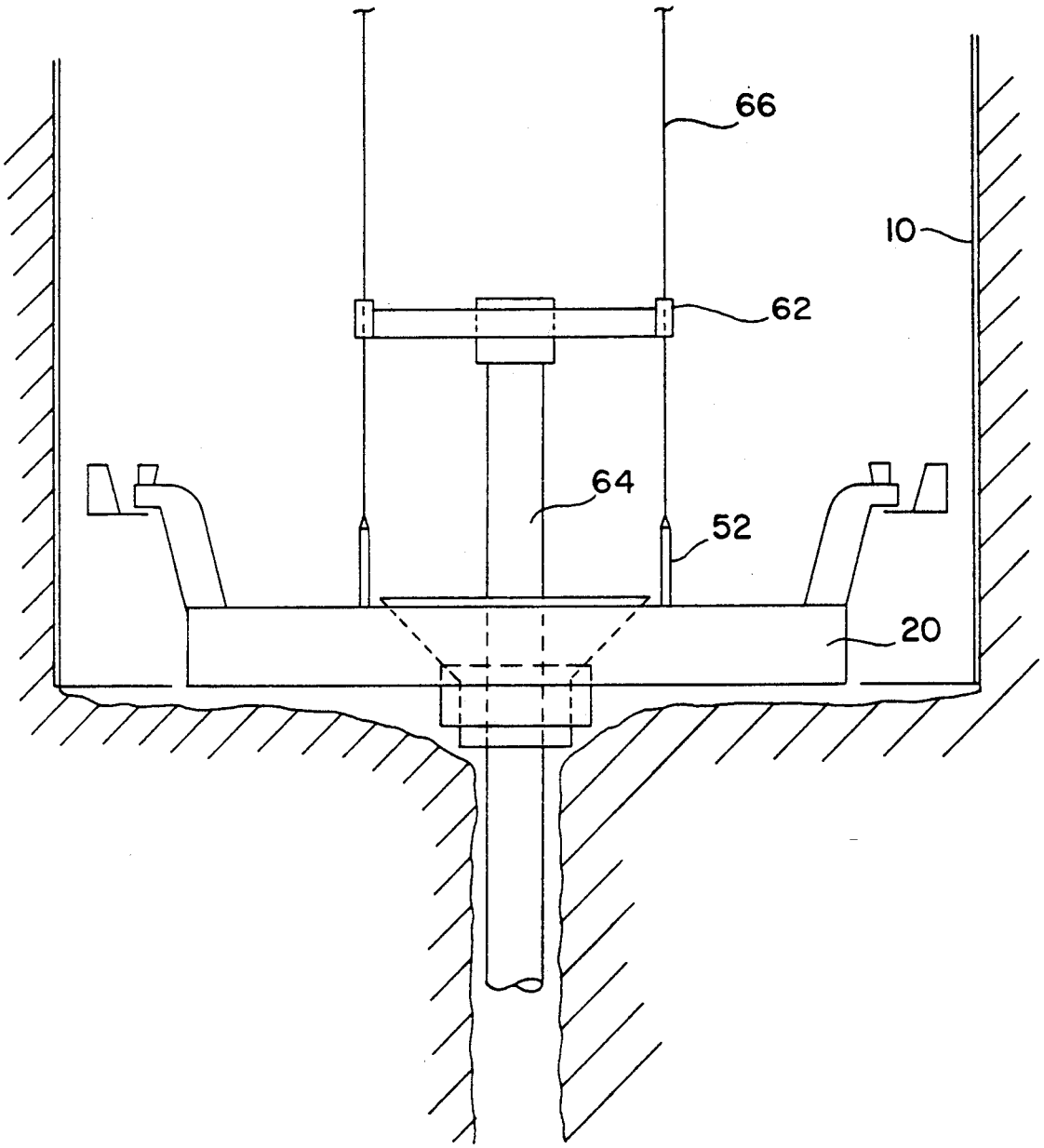

With reference to FIGS. 1 and 2, cylindrical-glory hole silo 10 sits in glory hole 2 formed in the ocean floor below the mudline 4 in the manner described above. Well casing 5 extends upwardly from the oil well through the centre of guidebase 20 and spool module 24 into the well head at Christmas tree 25. Vertical valve overrides are provided at 26. The blow-out protector envelope is indicated at 27. A cantilevered flowline alignment porch is indicated at 44. Mounted on this porch is receiver funnel 46. The flowline umbilical 48 extends outwardly into a flowline trench 50 which is formed below the mudline 4.

The guidebase 20 locks into the nose portion 11 of the silo 10 by means of pins 21 which fit into notches 12. As described in further detail below, guidebase 20 provides a stable platform for mounting equipment inside the glory hole and also provides support for casing 5 while the well is drilled. Guidebase 20 is equipped with posts 23 for centring equipment at the wellhead.

The guidebase 20 is shown in FIGS. 4 through 8. It has a frame 50, a central funnel 51, centring pins 52, pod line attachments 53, support arms 54 and suction pipe 58. It is installed immediately following completion of the casing installation. As shown in FIG. 8A, guidebase 20 is lowered on the drill string 41 used to grout between the silo 10 and the sides of hole 2 and on the floor of the hole 2. The guidebase 20 is guided by lines 55 attached to line attachments 53 into the casing 10 until support arms 54 sit in arm cradles 56 in nose ring 11, where they are locked into place. Guide lines 66 remain attached to centring pins 52 to permit subsequent equipment to be centred on the guide base. An airlift system 59 attaches to suction pipe 58 to remove drill cuttings or excess cement. A centring frame 60 can then be lowered onto the guidebase. Funnel 51 serves to centralize the bit for drilling the hole for the surface casing string. After the surface casing hole is drilled, a permanent guidebase 62 and attached casing 64 is lowered onto centring pins 52 and the casing is cemented into place. The permanent guidebase 62 is not itself attached to guidebase 20 and it can move vertically in relation to guidebase 20 even after cementing of the casing. Spool module 24 and Christmas tree 25 are then secured to pins 52. In production, the product will be conveyed through flow lines 28.

With reference in particular to FIG. 11, the wellhead protection system of the invention incorporates a unique roof and cantilevered porch which exhibit a number of benefits. The roof side walls deflect trawler boards etc. over the structure. The roof prevents ingress of silt and protects the equipment against dropped objects. The porch structure allows a conventional pull-in system to be used to connect equipment in the silo to sub-sea pipelines. The roof assembly protects equipment installed in the silo from damage from dropped objects and prevents ingress of silt. The particular geometrical configuration for the flow loop and control umbilical spools also permits significant deflection without overstressing the spools. All the components are designed to prevent fishing gear snagging.

The silo 10 consists of three sections, upper silo 72, porch support 74 and nose ring 76. The porch support 74 (44 in FIG. 1) supports the porch 70 (45 in FIG. 1) and is connected to the upper wall of the casing prior to drilling. The porch support 70 is attached by pins to the upper wall of the silo 10 while the silo is still in the moonpool.

The silo structure is shown in detail in FIG. 12. Nose ring 76 consists of a heavy steel shell 20 mm thick rolled to a 7.3 m. interior diameter and reinforced by vertical ribs. It is typically 1.6 m. high and has a sharpened leading edge 77 to facilitate penetration. A plenum 79 may be formed by welding a rolled section to the interior of the nose ring. By cutting holes to the exterior of the shell, the plenum 79 can be used to provide lubrication or grout to the area between the nose ring and the hole at the various stages of the drilling operation. The upper silo 72 consists of a 10 mm thick steel shell 81 rolled to a 7.3 m. inside diameter, reinforced by vertical ribs 82 connected to horizontal rings 80. Some of the vertical ribs 82 are hollow to provide a path for water circulation to the inside of the silo by way of connecting inlets in the silo roof. A stiffening ring 84 is provided to provide added strength for supporting the roof and accommodating shear loads. The upper silo is approximately 7.4 m. in height giving the entire structure a height of 9 m. The silo and porch support are protected from corrosion by a coating system and cathodic protection anodes 86. The coating system is designed such that all structural carbon steel surfaces permanently exposed to seawater have a paint coating consisting of 1 coat Coal Tar epoxy primer, 2 coats Coal Tar epoxy, 1 coat white epoxy and 1 coat yellow epoxy. External surfaces of the silo which are subject are coated with 1 coat Zinc ethyl silicate primer, 1 coat Epoxy tie coat, 2 coats Epoxy intermediate coat and 1 coat yellow Epoxy top coat. For the interior of the silo, where improved visibility for an ROV is obtained by the use of white paint, 1 coat of Coal Tar Epoxy primer, 3 coats Coal tar epoxy and 1 coat white Epoxy Top coat are used. To assist maintenance operations, the well designation number, compass markings (north, south, east, west), height above mudline and access panel labels are painted on the roof and side wall exteriors. As a back-up to the coating system, a sacrificial anode system is incorporated to provide galvanic protection. Each structural component has an isolated system to allow independent retrieval of components. 93 anodes are spread throughout the system.

The porch support 70 consists of a welded structural steel assembly which incorporates the female receptacles 88 of a guidance and lock down system for the porch which is described below in further detail. It also includes guide line stabs 90 and side wall stabs 92. The porch support is designed permit the porch to be latched or unlatched and to accommodate pull-loads and snag loads and to transfer these loads to the casing.

FIGS. 14 through 17 show the adjustable lock down system for the porch in further detail. Porch support 74 has support struts 75. Porch 70 is provided with four stab locks 150, two on each edge. The stab locks are in stab clamps 152 which in turn are mounted on wings 160 which in turn are bolted to porch 70 by bolts 162 through porch adjustment holes 164. The particular adjustment holes are selected to properly locate the porch on the silo. Plate 160 also has a guide wire guide 158. Stab locks 150 have spring-operated retractable hooks 154 to engage in the female lock-down stabs 88.

The roof structure consists of the side wall 94, silo roof 96 and porch roof 98. The side wall 94 is made in sections that are designed to fit around the extreme outer edge of the silo (including the porch support). These sections are latched to the stiffening ring 84 at the top of the upper silo by removable lock stabs. This is done in the moon pool after the porch support 70 is attached. The latching mechanism facilitates removal for sea floor clearing or replacement if a side wall section is damaged by snagging.

FIGS. 19 and 20 show the side wall stab-in connections. The bottom surface of side wall 94 is provided with a hollow stab element 182 which has pivotable locks 184. When bullet-shaped retainer 188 is removed, the locks can retract. With the retainer in place as shown in FIG. 188, the locks cannot be retracted. Stab 182 is inserted in female element 190 of stiffening ring 84 with retainer 188 removed. With the stab 182 in place as shown in FIG. 19, retainer 188 is lowered into place by a guide line, guided by guide 189. This locks the side wall in place on the silo.

The side wall sections are sufficiently non-rigid to deform under the full load conditions imposed in the event of a troll board snag and are replaceable using diverless techniques. The side walls form a forty-five degree angle with the roof to avoid snags. The side wall sections also incorporate a vertical skirt 95 at the lower edge that protrudes below the mudline 4 after the installation process is completed. The purpose of this skirt is to further reduce opportunities for snagging by preventing hooking under the side wall. The skirt is supported by compression gussets that transfer loads back to the silo.

The silo roof 96 over the blow-out protector and tree area consists of a single large section which is flat in profile. The silo roof is supported vertically on the stiffening ring 84 and laterally by the side wall 94. In this way, under loading conditions load is transmitted from the roof section to the silo. A metal to metal seal is also formed which prevents the ingress of sediment into the silo. Two large hatches 108 are provided in the silo roof over the choke and control pod areas which facilitate maintenance operations on the choke and control pod, with a third smaller hatch 104 over the tree cap area. The hatches are capable of withstanding dropped object impact loads and are designed to be wireline retrievable. The hatches are supported in recesses in the silo roof which incorporate metal to metal seals to prevent silt from entering the silo of these joints. In this way only the portion of equipment being worked on is exposed at any given time. The hatches are supported in recesses in the silo roof which incorporate metal to metal seals and the hatch profiles and their interfaces with the silo roof structure are flush to avoid snagging. Openings 105 in the hatches are directly over the centring pins 52.

The internal configuration of the roof is such that traps 106 are provided that allow the accumulation of hydrocarbon in areas of stagnation on the underside of the silo roof. In the event that hydrocarbon detection is required, sensors can be mounted and run with the tree. These sensors would be designed to project into the traps on the underside of the roof while at the same time being configured to avoid interference with other equipment or operations. Connections to the sensors would be through the control umbilical. The silo roof incorporates downcomer pipes 102 that are located to align with the water circulation tubes 82 in the silo wall. These downcomers are connected through metal to metal contact with their companions located in the upper silo when the silo roof is installed. The silo roof will be retrieved on drill pipe for operations requiring unrestricted access to the blowout protector or tree envelope. The silo roof would be removed for installation of the flow loop and control umbilical spools, operations involving the blow-out protector and any well servicing operations requiring removal of the tree. Otherwise, maintenance work could be conducted through one of the hatches.

The porch roof 98 covers the porch, pull-in funnels and the flow loop and control umbilical spool connections. It is deployed after the flow loop spool to flow line jumper connection has been completed. The porch roof is supported by side walls 99 that project along the sides of the porch support and is installed in flush-mounted sheer keys similar to the silo roof. These sheer keys incorporate metal-to-metal seals to prevent ingress of silt. The porch roof does not incorporate inspection hatches. It is also configured internally to provide for traps for hydrocarbon accumulation and detection.

The flow line and control umbilical are protected from debris by mattress 120 (FIG. 11) consisting of concrete blocks stitched on a tough fabric, measuring 3 m. by 4 m. by 0.3 m. thick. It is placed over the porch flow line openings and on the angled the angled edges of the porch roof. It is pulled away for removal of the flow line or umbilical.

As indicated above, the porch support 74 is assembled on the silo 10 prior to lowering to the sea bed. The glory hole is drilled as indicated above and the silo 10 installed in the hole. The guide base 20 and permanent guide base 62 are installed as indicated above and the drill casing 5 is cemented into place. Next the porch 70 is deployed and guided into place by guide wires attached to the porch support. The porch 70 is locked to the porch support with adjustable location stab locks. The porch can be deployed on the drill string by the same drilling unit that installs the tree and flow loop spool. The hub end of the flow loop spool can be positioned anywhere within certain installation tolerances. To accommodate these tolerances, the porch will be fitted with adjustable stab locks to lock the porch to the porch support.

The flow loop spool is deployed with the tree as a complete assembly. The tree valves are typically manually overridden horizontally, but due to the restriction on horizontal access created by the silo, the tree used with the present invention is provided with vertical valve overrides. A control stab plate is located at the top of the tree and an angle drive is installed between the standard horizontal valve overrides and the control stab plate. An ROV can then operate the valves from above.

The basic tree envelope is approximately 3.5 m. by 4 m. leaving a clearance between the tree and the inside of the silo of 1.2 to 1.4 m. at the corners of the envelope. The critical tolerance is that related to the outer end of the flow loop spool at hub 43. The hub end 43 of the flow loop spool rests in a saddle on the porch while the tree end is fixed to the outlet of the choke. Assuming that the tree is installed within a total maximum verticality tolerance of 1 degree and the silo is installed within a total maximum verticality tolerance of 2 degrees for a total silo/wellhead maximum installation tolerance of 3 degrees, then the stress limits of the design codes dictate that the hub end has a vertical tolerance of about 194 mm up or down, for a total movement of about 388 mm, and a horizontal tolerance of about 105 mm in either direction, for a total tolerance of 210 mm. However the porch installation procedure is designed so that an adjustable latch down mechanism compensates for the misalignment of the silo and tree so that in fact the maximum displacement is reduced to 50 mm in each direction. The flow loop spool is attached to the tree on board the drilling unit and is deployed with the tree as a complete assembly. The hub end 43 rests in a saddle on porch 40, while the tree end is fixed to the outlet of the choke.

The porch installation procedure is arranged to allow installation tolerances that have occurred in the installation of the silo and the porch support to be negated by providing a porch latch-down mechanism that is adjustable in three axes.

The roof sections are next deployed using either the drilling unit that installs the silo, the drilling unit that drills the well or both. The silo roof is first deployed without the hatches in place to allow water to pass through the openings. It is guided into place using guide wires on the guide posts 52. The running tool for the silo roof has a standard square guide wire funnel pattern with a central locking device which connects to the centre of the roof. The central locking device is locked to the roof by rotating the drill string counterclockwise. The silo roof hatches are deployed using a stab-end running tool using spring-loaded locks and a weighted sleeve release tool. The guide wire is used to guide the running tool to the correct location. The centre hatch is guided by a running tool frame on the four guide wires. The same stab-end tools used for the rectangular hatches can be used. After all the silo roof hatches are installed, the guide wires can be disconnected from the guide posts and retrieved. The porch roof is guided into place using guide wires that have been established on the guide posts on the porch support. The guide wires are run through funnels in the running tool for orientation and correct placement of the roof section. The porch roof is deployed after the flow loop spool to flow line jumper connection has been completed.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A glory hole silo for installation in a glory hole in a subsea surface, comprising:

a) a cylindrical casing open at the upper end thereof;

b) a porch having an upper surface for supporting a hydrocarbon-carrying flowline, said porch secured at one end thereof to said upper end of said casing and extending horizontally from and cantilevered with respect to said upper end of said casing, the upper surface of said porch forming a generally horizontal planar area opening to the interior of said casing and provided with means communicating with the interior of said casing for attaching said flowline; and c) a removable roof extending over the open upper end of said casing and over said porch.

2. The silo of claim 1 wherein said porch comprises a porch support having an upper surface and secured at one end thereof to said casing and a porch platform removably secured to said upper surface of said porch support, said porch platform provided at an end thereof distant from said casing with a sloping ramp.

3. The silo of claim 1 wherein said porch comprises a plurality of apertures for receiving removable locking means for securing said means communicating with the interior of said casing for attaching a flowline.

4. The silo of claim 1 wherein said roof comprises a flat roof section over the porch, a flat roof section over the open upper end of said casing, and a side wall extending around the perimeter of said porch and casing roof sections, and forming an acute angle with said roof sections.

5. The silo of claim 4 wherein said side wall comprises an angle of 45 degrees with said roof sections.

6. The silo of claim 4 wherein said side wall further comprises a skirt long the lower edge thereof adapted to extend below said subsea surface when said silo is installed in said glory hole.

* * * * *